United States Patent [19]

Motta

[11] Patent Number: 4,970,977

[45] Date of Patent: Nov. 20, 1990

[54] PORTABLE, SINGLE-THREAD CHAIN STITCH, BAG CLOSING MACHINE WITH A MOVABLE NEEDLE GUIDING DEVICE

[75] Inventor: Bruno Motta, Milan, Italy

[73] Assignee: Union Special GmbH, Stuttgart, Fed. Rep. of Germany

[21] Appl. No.: 377,661

[22] Filed: Jul. 10, 1989

[30] Foreign Application Priority Data

Jul. 23, 1988 [DE] Fed. Rep. of Germany ..... 3825094

[51] Int. Cl.[5] ..... D05B 55/06

[52] U.S. Cl. ..... 112/227; 112/11

[58] Field of Search ..... 112/10, 11, 169, 227, 112/261; 53/139

[56] References Cited

U.S. PATENT DOCUMENTS

| | | | |
|---|---|---|---|
| 434,996 | 8/1890 | Sawtell | 112/227 |
| 1,387,094 | 8/1921 | Barron | 112/227 |
| 1,738,644 | 12/1929 | Gatchell | 112/227 |
| 2,444,657 | 7/1948 | Vesconte et al. | 112/11 |
| 2,496,243 | 1/1950 | Clayton | 112/227 |
| 2,577,430 | 12/1951 | Peterson et al. | 112/227 X |
| 2,960,946 | 11/1960 | Lutz et al. | 112/11 |

FOREIGN PATENT DOCUMENTS

| | | | |
|---|---|---|---|
| 1522080 | 3/1968 | France | 112/10 |
| 213001 | 8/1984 | German Democratic Rep. | 112/227 |
| 346889 | 9/1972 | U.S.S.R. | 112/11 |

*Primary Examiner*—Werner H. Schroeder
*Assistant Examiner*—David K. Suto
*Attorney, Agent, or Firm*—Morgan & Finnegan

[57] ABSTRACT

A portable, single-thread chain stitch bag closing machine has a movable needle guiding device. A looper mounted so as to be slidable in a feed direction of a workpiece and pivotable transversely to the feed direction is protected against damage or breakage by a needle guide which guides a needle in the feed direction of the workpiece when the looper pivots towards the needle. The needle guide thereby ensures that a point of the looper reliably pivots past the needle, without coming into contact with the needle.

1 Claim, 4 Drawing Sheets

PORTABLE, SINGLE-THREAD CHAIN STITCH, BAG CLOSING MACHINE WITH A MOVABLE NEEDLE GUIDING DEVICE

BACKGROUND OF THE INVENTION

The invention relates to a needle guiding device for a portable, single-thread chain stitch, bag closing machine with a movable needle guiding device.

One form of movable needle guiding device in a portable bag closing machine is disclosed in U.S. Pat. No. 2,960,946, wherein the needle guide is secured by means of a screw to a pivotable holder which also carries a lower feed dog. Thus, this needle guiding device performs a pivoting movement corresponding to the pivoting movement of the lower feed dog. The chain stitch is formed, inter alia, by a large sliding movement of a looper transversely to a feed direction of a workpiece and by a small pivoting movement of the looper in the feed direction of the workpiece. Although this movement of the looper is advisable and advantageous for forming a two-thread double chain stitch, formation of a single-thread, single chain stitch with the same looper drive mechanism additionally requires a special loop retainer which is mounted on the underside of the throat plate. The purpose of the loop retainer is to spread out a needle thread loop located on the looper, in order that the needle can pass through the needle thread loop. The loop retainer has to be adjusted very accurately and, since it comes into engagement with the sewing thread during the formation of each stitch, it is subjected to a certain amount of wear which can lead to undesirable faulty stitches.

In the case of hand-guided bag closing machines, there is generally the risk that the needle of the bag closing machine will be unintentionally subjected to transverse stress when closing bags, which may lead to damage to, or even fracture of, the looper.

SUMMARY OF THE INVENTION

An object of the present invention is to design a needle guiding device for a single chain stitch portable bag closing machine provided with a handle, in such a way that a single-thread, single-chain stitch can be formed by simple means and without impairing the reliability of the sewing operation and the looper is protected against damage caused by needle deflection in the direction in which the workpiece is conveyed.

In accordance with the present invention there is provided a needle guiding device for a portable, single-thread chain stitch, bag closing machine provided with a handle, having a throat plate, a feed mechanism for conveying a workpiece, a looper which is movable about a path of movement of a needle and driven by a looper drive mechanism, and a movable needle guide disposed below the throat plate, wherein the looper is mounted so as to be displaceable in the feed direction of the workpiece and pivotable transversely of the feed direction and wherein the needle guide is disposed so as to be movable transversely to the feed direction and is operatively connected to the looper in such a way that the needle guide guides the needle in the feed direction of the workpiece when the looper pivots towards the needle.

By using a needle guide which is movable transversely to the feed direction and which guides the needle in the feed direction when the looper pivots towards the needle, it is ensured that the tip of the looper reliably pivots past the needle without coming into contact with the needle. Moving the needle guide out of the guide position makes it possible for the looper to move about the path of movement of the needle.

A particularly advantageous development occurs when the needle guide is driven so as to be pivotable about a bearing spindle of the looper drive mechanism and the pivoting movement of the needle guide being derived from the looper driving mechanism and the sliding movement of the looper being compensated by a sliding joint having a pin which projects into a guide eye. This provides a particularly simple construction of the needle guiding device, since the existing pivoting movement of the looper is transmitted to the needle guide. The sliding movement of the looper, interfering with the movement of the needle guide, is compensated by a sliding drive of the needle guiding device, wherein a pin disposed on the looper holder engages a guide eye of the bridge-type holder which carries the needle guide.

A further development occurs if the needle guide is adjustably secured to a bridge-type holder which is disposed so as to be pivotable about the bearing spindle. This enables precision adjustment of the needle guide relative to the needle and to the looper.

DESCRIPTION OF THE DRAWINGS

The invention will be described hereinafter, by way of example only, with reference to and as illustrated in the accompanying drawings, in which.

DESCRIPTION OF THE PREFERRED EMBODIMENTS

Figure 1:
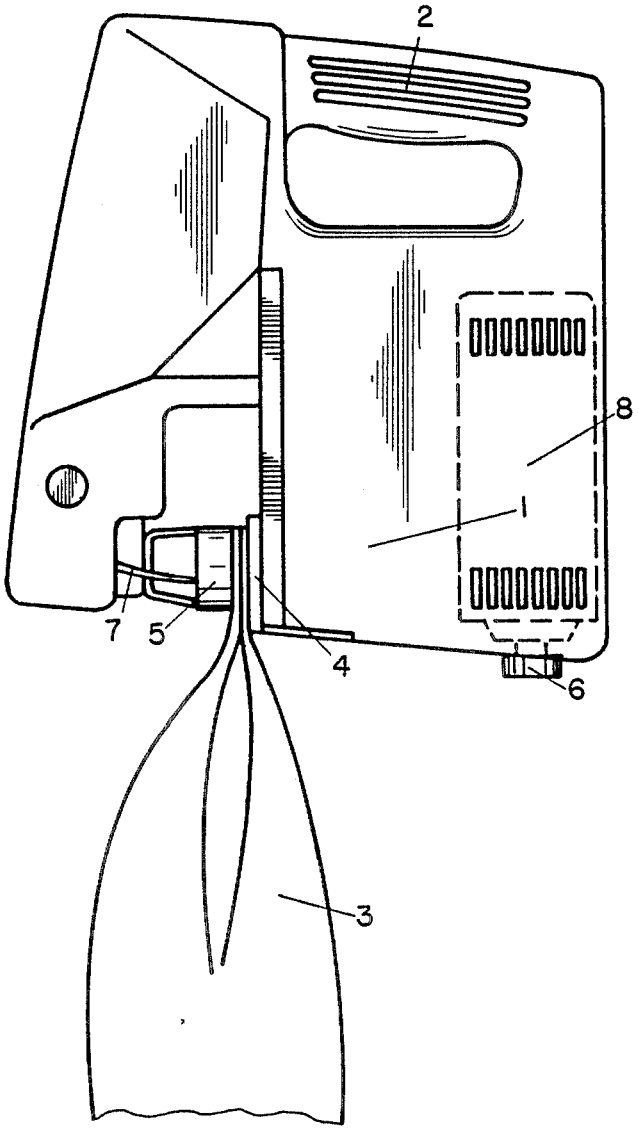
FIG. 1 is a view of a side elevation of one embodiment of a portable bag closing machine provided with a handle, in accordance with the present invention.

FIG. 1 shows a portable, single-thread chain stitch bag closing machine by which, for example, the opening of a bag is closed. The bag closing machine has a sewing machine housing 1 with a handle 2, the needle guiding device being mounted in the sewing machine housing 1. A workpiece 3 to be closed, which may be a bag, is guided between a throat plate 4 and a resiliently mounted pressure foot 5. A needle 7 may be moved back and forth by way of a handwheel 6.

The actual drive of the bag closing machine is effected by a motor 8 disposed in the sewing machine housing 1.

Figure 2:
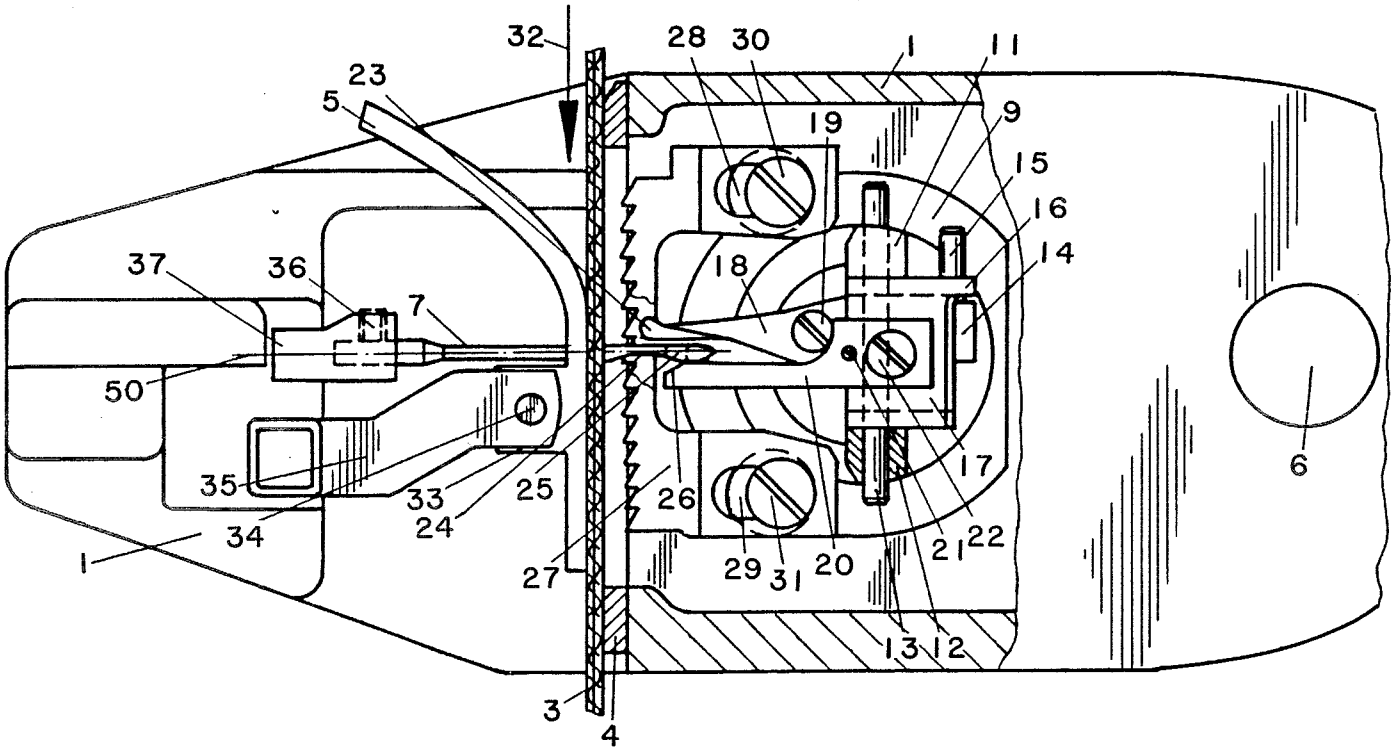
FIG. 2 is an inverted plan view of the bag closing machine having a needle guiding device.

Referring to FIG. 2, a looper housing 9 which is part of a looper driving mechanism 10 (FIG. 5) carries respective bearing eyes 11 and 12 in which a bearing spindle 13 is rotatably and slidably mounted. A looper holder 14 pressed onto the bearing spindle 13 carries a pin 15 which is slidably mounted in a guide eye 16 of a pivotable bridge-type holder 17.

A looper 18 is screwed to the looper holder 14 by means of a screw 19. A needle guide 20 is provided on the bridge-type holder 17 and is secured to the bridge-type holder 17 so as to be adjustable towards the looper 18 by means of a grub screw 21 and towards the needle 7 by means of a screw 22.

A point 23 of the looper 18 is located above a clearance groove 24 of the needle 7 which has an eye 25. A chamfered portion 26 on the needle guide 20 facilitates the guidance of the needle 7 in the feed direction of the workpiece 3.

The feed mechanism for conveying the workpiece 3 includes a feed dog 27 to which a lifting movement and a feed movement are imparted by way of respective eccentric shafts 28 and 29 and which is guided by a respective collar screw 30 and 31. An arrow 32 illustrates the feed direction of the workpiece 3.

The pressure foot 5 supporting the workpiece 3 has a boss 33 which is hinged to a pressure foot holder 35 by way of a support bolt 34. The needle 7 is secured in a needle head 37 by means of a screw 36.

Figure 5:
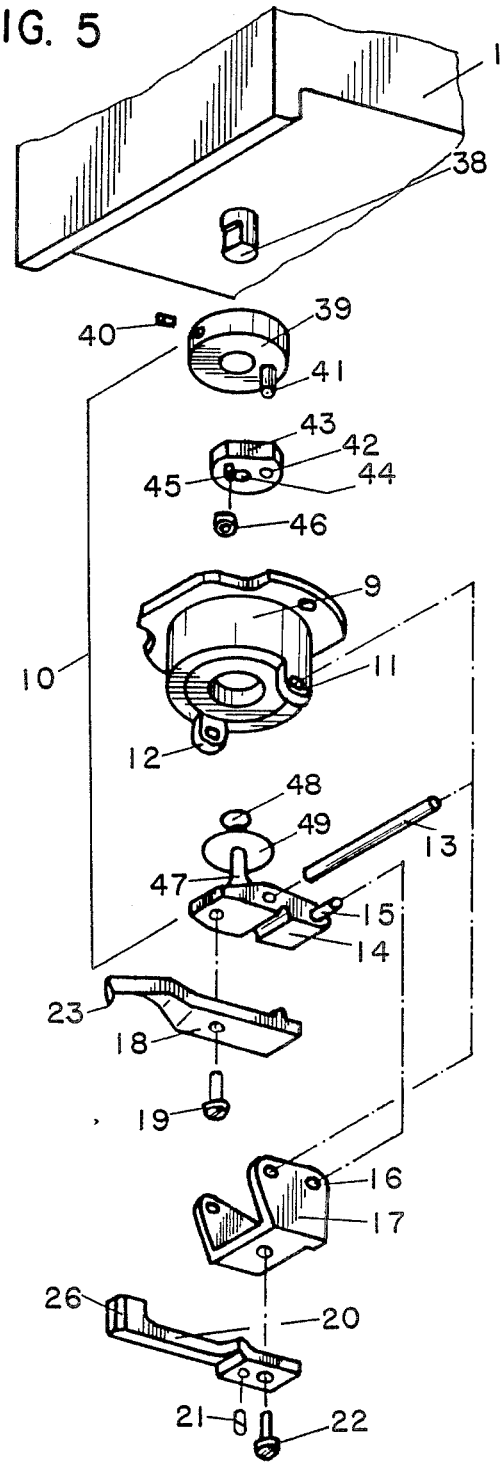
FIG. 5 is a perspective exploded view of a looper driving mechanism with a needle guiding device.

As may be seen in FIG. 5, a crank disc 39 having a crankpin 41 is secured by means of a grub screw 40 to a rotatingly driven main shaft 38 which is journalled in the sewing machine housing 1. The crankpin 41 extends into a bore 42 in a driver 43 which includes a further bore 44 and a stud 45. A sleeve 46 is supported on the stud 45 and extends into a cam track located in the looper housing 9. The looper holder 14 has a shank 47 with a spherical end 48 and cover plate 49, wherein the spherical end 48 extends into the further bore 44.

Figure 3:
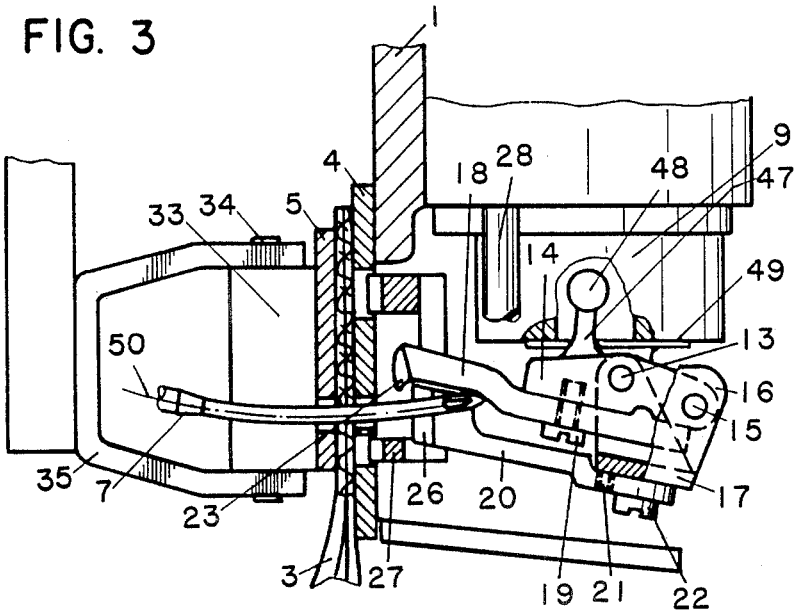
FIG. 3 shows a lateral cutaway portion of the bag closing machine with the needle in its right-hand end position.
Figure 4:
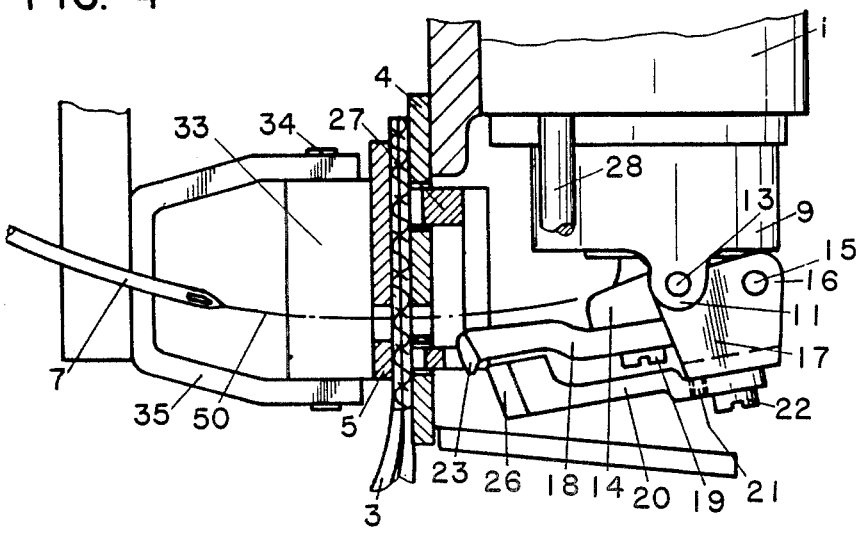
FIG. 4 shows a lateral cutaway portion of the bag closing machine with the needle in its left-hand end position.

The needle guiding device operates in conjunction with the looper driving mechanism 10 in the following manner. A sliding movement in the feed direction of the workpiece 3, and a pivoting movement transversely to the feed direction, are imparted to the looper 18 from the rotary movement of the main shaft by means of the looper drive mechanism 10 which may be in the form of a drag link drive. As may be seen in FIG. 2, the needle guide 20 supports the needle 7 which moves along a path of movement 50 during its movement into its rights-hand end position shown in FIG. 3. The looper 18 pivots towards the needle 7, wherein the needle guide 20 ensures that the looper point 23 does not strike against the needle 7, but moves closely past the needle in the region of the clearance groove 24 and, hence, prevents damage to the looper 18. FIG. 4 shows the needle 7 in its left-hand end position. The looper 18 can then perform its movement about the arcuate path of movement 50 of the needle 7 without being obstructed by the needle guide 20.

The foregoing detailed description is given for clearness of understanding only, and no unnecessary limitations should be understood therefrom, as modifications will be obvious to those skilled in the art.

I claim:

1. A needle guiding device for a portable, single-thread chain stitch, bag closing machine provided with a handle, having a throat plate, a feed mechanism for conveying a workpiece, a looper which is movable about a path of movement of a needle, a looper drive mechanism for driving the looper, a movable needle guide disposed below the throat plate, means for mounting the looper so as to be displaceable in a feed direction of the workpiece and pivotable transversely of the feed direction, means for mounting the needle guide so as to be movable transversely to the feed direction and means for connecting the needle guide to the looper in such a way that the needle guide guides the needle in the feed direction of the workpiece when the looper pivots towards the needle, with said looper drive mechanism having a bearing spindle, means for pivotally driving the needle guide about the bearing spindle, with a pivoting movement of the needle guide being derived from the looper driving mechanism, a sliding movement of the looper being compensated by a sliding joint, a bridge-type holder having a guide eye and being pivotally mounted on the bearing spindle, means for adjustably securing the needle guide to the bridge-type holder, and with the sliding joint having a pin which projects into the guide eye.

* * * * *